United States Patent [19]

Leetmaa

[11] 4,028,651

[45] June 7, 1977

[54] COUPLED-CAVITY MICROWAVE FILTER

[75] Inventor: Juri G. Leetmaa, Los Angeles, Calif.

[73] Assignee: Hughes Aircraft Company, Culver City, Calif.

[22] Filed: May 6, 1976

[21] Appl. No.: 683,979

[52] U.S. Cl. ..... 333/73 W; 333/83 R; 333/83 A; 333/98 M

[51] Int. Cl.[2] ..... H01P 1/20; H01P 5/04; H01P 7/06; H01P 1/16

[58] Field of Search ..... 333/73 W, 83 R, 73 R, 333/98 R, 27, 98 M, 83 A; 334/41–42; 331/96, 101

[56] References Cited

UNITED STATES PATENTS

| | | | |
|---|---|---|---|
| 2,524,268 | 10/1950 | McCarthy | 333/73 W X |
| 2,740,094 | 3/1956 | Fox | 333/73 W |
| 3,137,828 | 6/1964 | Gerig et al. | 333/83 X |
| 3,544,927 | 12/1970 | Elder et al. | 333/98 R X |
| 3,899,759 | 8/1975 | Hines et al. | 333/73 W |

*Primary Examiner*—Alfred E. Smith
*Assistant Examiner*—Marvin Nussbaum
*Attorney, Agent, or Firm*—John Holtrichter, Jr.; W. H. MacAllister

[57] ABSTRACT

A coupled-cavity microwave filter including a plurality of relatively high Q cylindrical cavity filters, a relatively large non-adjustable iris aperture coupling adjacent ones of the cavities, a relatively smaller secondary tuning aperture located near the edge of the irises separating the cavities, each such secondary tuning aperture containing a tuning screw extending through the wall of the cavity in order to provide adjustment of the coupling between such adjacent cavities without degrading the cavity Q.

6 Claims, 4 Drawing Figures

COUPLED-CAVITY MICROWAVE FILTER

BACKGROUND OF THE INVENTION

The background of the invention will be set forth in two parts.

FIELD OF THE INVENTION

This invention relates generally to the field of microwave filters and more particularly to coupled tunable cylindrical cavity filters.

DESCRIPTION OF THE PRIOR ART

In microwave filters with exact performance requirements, it is desirable to employ tuning adjustments to alleviate the need for unreasonable fabrication tolerances. In rectangular waveguide filters, the coupling between filter cavities is made adjustable by the use of a tuning screw in the plane of the coupling iris. An example of this type of filter is found in U.S. Pat. No. 3,544,927.

On the other hand, in high Q cylindrical cavity filters having relatively thin iris plates provided with circular, slot or cross-coupling apertures, the iris plate thickness is much less than the diameter of the tuning screw and makes the use of such screws impractical.

In the past, the coupling on this type of filter was adjusted by reaming or machining the irises, which is an expensive and time-consuming task. In fact this technique is not practical with filters fabricated from invar, since this material must be silver plated before electrical tests can be made. The plating has to be removed before any modification can be made, and the filter must be replated before retesting. On narrow bandwidth cylindrical cavity filters, standard machine shop tolerances prevent optimum filter responses from being obtained.

SUMMARY OF THE INVENTION

In view of the foregoing factors and conditions characteristic of the prior art, it is a primary object of the present invention to provide an improved coupled-cavity microwave filter.

Another object of the present invention is to provide a simple yet effective and economical technique for producing a high Q coupled-cavity microwave filter.

Still another object of the present invention is to provide a high Q coupled cylindrical cavity microwave filter designed for either single or dual mode operation and using either circular slot or crossed slot irises.

In accordance with one embodiment of the present invention, a coupled-cavity microwave filter providing a narrow bandwidth with precisely controlled frequency response includes a plurality of relatively high Q cylindrical cavity filters and at least one relatively larger non-adjustable primary iris aperture for coupling between the adjacent cavities. Also included is a relatively smaller secondary tuning aperture disposed adjacent the outer edge of the iris, the secondary tuning aperture containing a tuning screw extending through a wall of the cylindrical cavity for precisely adjusting the coupling between the adjacent cavities without degrading the cavity Q's of either adjacent cavity.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

DESCRIPTION OF THE PREFERRED EMBODIMENTS

Figure 1:
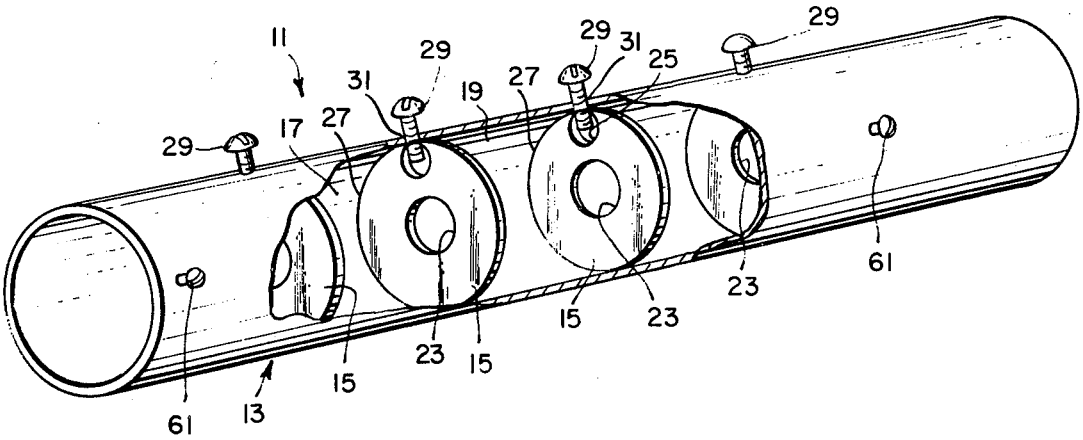
FIG. 1 is a perspective view of a coupled-cavity microwave filter having a plurality of cascaded high Q cylindrical cavities separated by irises incorporating the novel tuning means in accordance with the present invention.

Referring now to the drawing and more particularly to FIG. 1, there is shown a coupled-cavity microwave filter 11 constructed in accordance with a presently preferred embodiment of the invention and illustrating the basic principles of the invention. Within a circular wave guide section 13 are uniformly spaced, transverse planar iris plates 15 defining a plurality of tandemly disposed relatively high Q cylindrical cavity filters 17, 19, and 21, for example.

All iris plates 15 are identically constructed, each including a relatively large non-adjustable primary aperture 23 for coupling adjacent ones of the cavities, and each also including a relatively smaller secondary tuning aperture 25 located preferably immediately adjacent an outer edge 27 of the plates 15. A tuning rod 29 extends into each of the apertures 25 an amount determined by the amount of coupling desired. The rods 29 may be fabricated from a conductive or low loss dielectric material, and may be in the form of an elongated slug axially movable in an appropriately dimensioned holder, or simply in the form of a screw threadably engaged in an appropriately tapped hole 31 in the wall of the waveguide section 13 and in each iris plate 14, as seen in FIG. 1. By tuning these screws, the coupling between each adjacent cavity may be precisely adjusted without degrading the cavity Q's of the cavities.

The dimensions of the secondary or tuning apertures 25 are not critical but are relatively smaller than the dimensions of the primary apertures 23 and the positioning of the secondary apertures is also not critical because these apertures are not located in a high field area. In a typical design for cavity operation in the region of 4 GHz, for example, Q's of over 10,000 have been obtainable where the waveguide inner diameter was about 2 ½ inch, the iris plate thickness of about 0.03 inch, a secondary aperture of about ¼ inch and a primary aperture of about ¾ inch. The waveguide section and iris plates may be fabricated from a conductive material such as brass that has been silver plated, for example, or of invar, similarly plated. Also, the waveguide section, the iris plates, and tuning screws may be of the same material or of different materials which have essentially the same coefficients of expansion.

Figure 2:
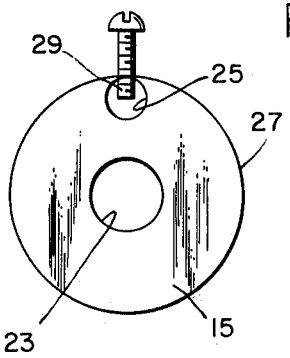
FIG. 2 is an elevational view of a circular iris of the type shown in FIG. 1.
Figure 3:
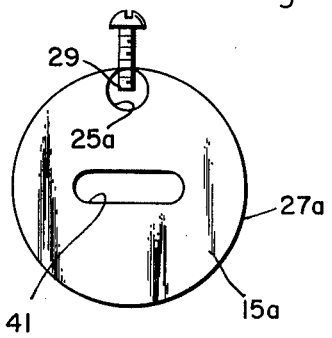
FIG. 3 is an elevational view of an iris having a primary non-adjustable slot and secondary tuning mechanism in accordance with another embodiment of the present invention.

The shape of the primary apertures 23 will depend upon the mode of operation desired, as is well known in the art. For example, a circular primary aperture 23 in the iris 15 of FIG. 2 may support two $TE_{111}$ modes, while an elongated primary coupling slot 41 may be provided in an iris plate 15A where only a single $TE_{111}$ mode having its E field perpendicular to the longitudinal axis of the slot may be coupled through the slot shown in FIG. 3. In the latter embodiment, the tuning aperture 25A is located at the edge 27A of the iris 15A on a line perpendicular to the axis of slot 41 to obtain essentially capacitive tuning of the coupling aperture.

Figure 4:
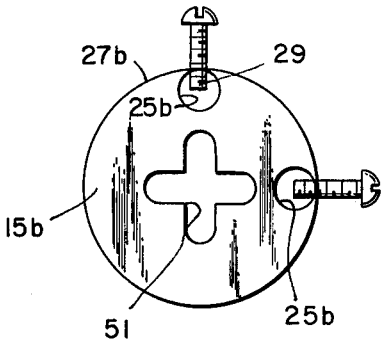
FIG. 4 is an elevational view of a dual mode slot iris incorporating a pair of secondary tuning mechanisms in accordance with still another embodiment of the present invention.

Referring now to FIG. 4, there is shown another embodiment of the invention supporting a dual mode of operation. Here, cross slots 51, 53 are symmetrically provided in the iris plate 15B, and two tuning apertures are located at the edge of the plate 15B in line with the axis of the two different slots. All such tuning slots are of course provided with tuning means such as the screws 29. In this embodiment, the cross slots allow coupling between cavities of orthogonal $TE_{111}$ modes, the coupling of each being adjustable by the tuning means provided in associated tuning apertures 25B. As shown in FIG. 1, conventional tuning screws 61 may be used which extend into the center of each cavity in order to adjust the resonant frequency thereof.

From the foregoing it should be evident that there has been disclosed a simple yet effective and economical technique and structure for providing a high Q, coupled-cavity microwave filter with the required adjustment capability to compensate for fabrication tolerances and inherent inaccuracies in theoretical filter designs. It should be understood that although certain materials and component shapes have been herein described, other materials and component shapes having the same characteristics may be utilized in practicing the invention.

What is claimed is:

1. A coupled-cavity microwave filter providing a narrow bandwidth with precisely controlled frequency responses, comprising:

a plurality of tandemly disposed, relatively high Q cylindrical cavity filters; and coupling means including a relatively large non-adjustable primary iris aperture for coupling adjacent ones of said cavities, said coupling means also including a relatively smaller secondary tuning aperture disposed adjacent the outer edge of said irises, each of said secondary tuning apertures containing a tuning screw extending through a wall of an associated one of said cylinders for precisely adjusting the coupling between such adjacent cavities without degrading the cavity Q's thereof.

2. The filter according to claim 1, wherein said primary iris aperture supports a single mode of propagation and coupling means includes a single secondary tuning aperture adjacent the outer edge of said iris.

3. The filter according to claim 2, wherein said primary iris aperture is circular.

4. The filter according to claim 2, wherein said primary iris aperture is a slot having a major axis, said secondary tuning aperture being disposed on a line passing through the center of said slot and perpendicular to said axis.

5. The filter according to claim 1, wherein said primary iris aperture supports a dual mode of propagation and includes a pair of orthogonally crossed primary coupling slots, a secondary tuning aperture being disposed opposite one end of each of said slots.

6. The filter according to claim 1, wherein said cylindrical cavity filters share a common cylindrical waveguide wall structure.

* * * * *